United States Patent [19]

Winn

[11] Patent Number: 4,468,871

[45] Date of Patent: Sep. 4, 1984

[54] TAP DANCING SHOE TAPS

[76] Inventor: Stanley Winn, P.O. Box 1537, Long Island City, N.Y. 11101

[21] Appl. No.: 434,565

[22] Filed: Oct. 15, 1982

[51] Int. Cl.[3] ..... A43B 5/12

[52] U.S. Cl. ..... 36/139; 36/113

[58] Field of Search ..... 36/113, 114, 136, 139, 36/8.3

[56] References Cited

U.S. PATENT DOCUMENTS

| | | | |
|---|---|---|---|
| 1,780,230 | 11/1930 | Haney | 36/8.3 |
| 1,967,334 | 7/1934 | Sothen | 36/8.3 |
| 2,105,642 | 1/1938 | Capezio | 36/8.3 |
| 2,124,908 | 7/1938 | Capezio | 36/8.3 |
| 2,739,394 | 3/1956 | Morgan | 36/8.3 |
| 3,007,260 | 11/1961 | Stone | 36/8.3 |
| 3,121,287 | 2/1964 | Patterson | 36/8.3 |

FOREIGN PATENT DOCUMENTS

| | | | |
|---|---|---|---|
| 109259 | 12/1943 | Sweden | 36/139 |
| 298838 | 10/1928 | United Kingdom | 36/113 |
| 500256 | 2/1939 | United Kingdom | 36/139 |

*Primary Examiner*—Werner H. Schroeder
*Assistant Examiner*—Tracy Graveline

[57] ABSTRACT

A shoe tap for tap dancing having first and second members pivotally connected by a pivot pin. The first member having a raised hemispherical protrusion with a first through-bore. The second member having a mating concave hemispherical recess coaxially disposed relative to a second through-bore. The pivot pin being of a diameter less than the first and second through-bore and extending therethrough and thereby not inhibiting the relative motion of the pivotally mounted second member to the first member affixed to the dancer's shoe.

6 Claims, 11 Drawing Figures

TAP DANCING SHOE TAPS

BACKGROUND OF THE INVENTION

This invention relates to tap dancing shoe taps and more particularly to a tap dancing shoe tap utilizing a raised substantially hemispherical protrusion as a pivot point to increase the tapping effect. Conventional tap dancing shoe taps have two members, i.e. a first and a second, pivotally mounted to each other via a pivot pin. In the conventional taps the two members produce a tapping sound as a result of slightly different curvatures of their respective cooperating surfaces. There is a minimal clearance between the two assembled members, thereby limiting their relative motion to each other, which ultimately inhibits their tapping effect. By increasing the distance between the two members of the tap in the tap assembly of the invention, while still maintaining a pivot point therebetween, the efficiency of the tap assembly is improved, and the tapping sound of the tap assembly is improved.

The improved construction also increases the useful life of the tap assembly. The creation of a raised generally hemispherical protrusion about the mounting hole of the first member will achieve this result.

SUMMARY OF THE INVENTION

It is an object of the present invention to provide a shoe tap assembly for tap dancing having first and second members pivotally connected by a pin, a raised hemispherical-shaped protrusion disposed at the internal pivot point of the first member and a mating cavity in the second member so that the second member can pivot in every direction about the pivot hemisphere on the first member and thereby increase the tapping effect.

Another object of the present invention is to provide a shoe tap for dancing having first and second members wherein the opened portion is closed on the first member, and thus yielding a larger mutual contacting surface area for the first and second members so that the tapping effect of the second member after impact is increased. In the improved tap assembly of this invention, the hemispherical protrusion on the first member will space the second member a predetermined distance from the first member which is greater than if the two members were conventionally mounted without the raised hemispherical protrusion.

Conventional taps afford relative limited motion of first and second members. However, the use of a raised hemispherical protrusion acting as a pivot point on the first member will allow the second member to move a limited defined distance much more freely in all directions and thereby in effect substantially increase the tapping action.

DESCRIPTION OF THE PREFERRED EMBODIMENTS

Figure 1:
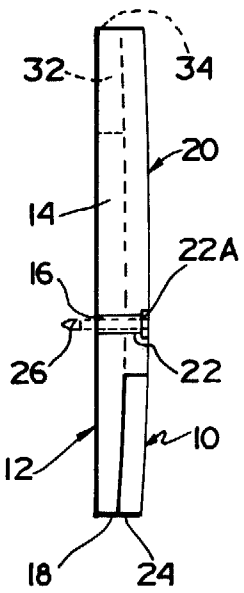
FIG. 1 PRIOR ART
FIG. 1 is a side view of the tap assembly of a conventional tap dancing tap.
Figure 3:
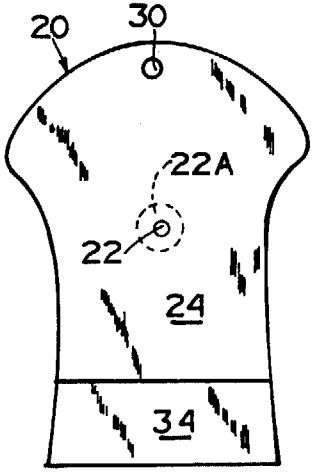
FIG. 3 is a plan view of the second member of the tap assembly shown in FIG. 1.
Figure 2:
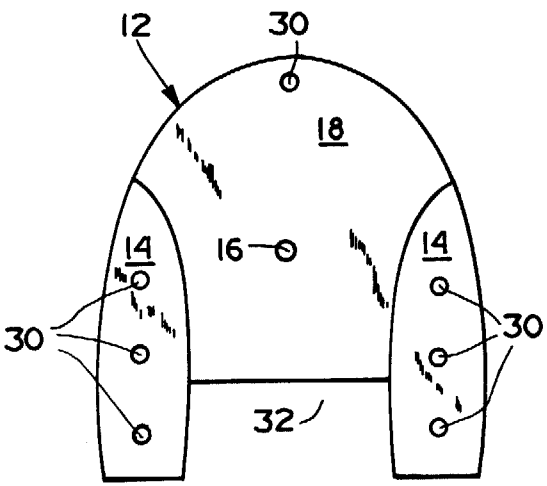
FIG. 2 is a plan view of the first member of the tap assembly shown in FIG. 1.
Figure 7:
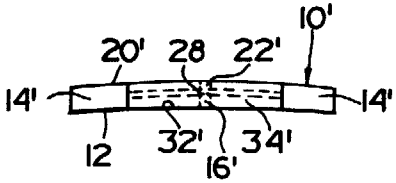
FIG. 7 is a side view along arrows 7—7 of FIG. 4.

Parts shown in the prior art of FIGS. 1-3, incl., are indicated by reference numerals excluding primes. Those parts in the first embodiment of FIGS. 4-7 and 11, whose parts are equivalent or similar to those of the prior art will be designated by the same reference numerals primed. Those parts in the second embodiment of FIGS. 8-10, incl., whose parts are equivalent or similar to those of the prior art will be designated by the same reference numerals double-primed.

Figure 4:
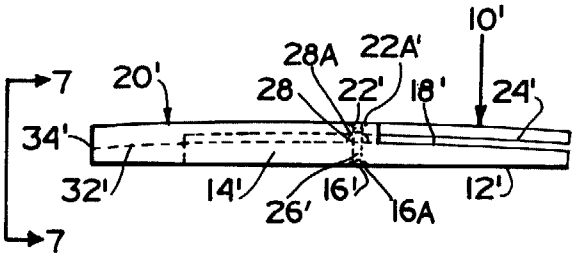
FIG. 4 is a side view of the tap assembly of the present invention showing the interconnection of parts.
Figure 11:
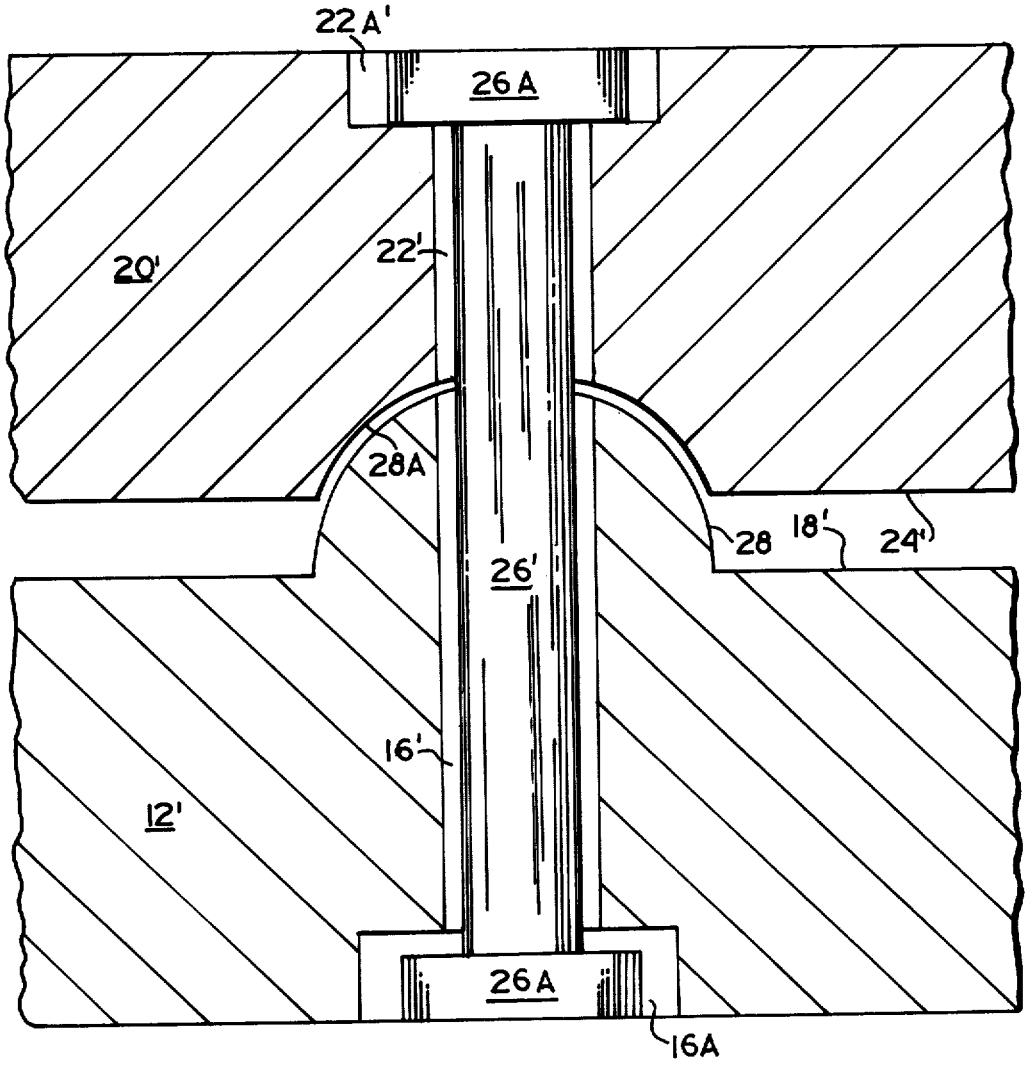
FIG. 11 is a detailed view showing the pivot mechanism of the tap assembly in FIG. 4.

In FIGS. 4 and 11 the shoe tap for dancing of the present invention is generally designated with the reference No. 10' utilizing a raised hemispherical protrusion 28 in the first member 12' which coacts with a concave hemispherical surface 28A in the second member 20' to form a pivot point.

Figure 6:
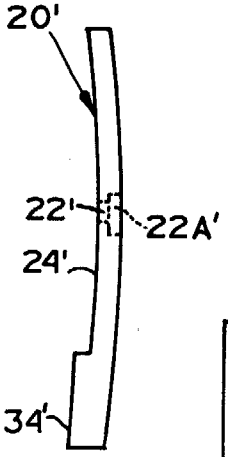
FIG. 6 is a side view of the second member of the tap assembly shown in FIG. 4.
Figure 5:
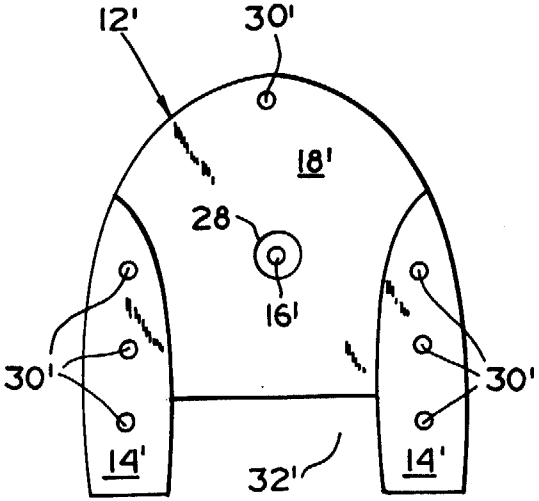
FIG. 5 is a plan view of the first member of the tap assembly shown in FIG. 4.

In. FIG. 5, the first member 12' is generally curved, having two raised side portions 14' and an open portion 32' whose boundary is defined by the raised side portions 14' and the first central portion 18'. In FIG. 6, second member 20' contains a raised back portion 34' which extends across its entire width. In operation, second member 20' can pivot about the raised hemispherical protrusion 28 much more freely in all directions.

In FIG. 11 after pivot pin 26' is placed through first member 12' and second member 20' the ends 26A are pressed so that they occupy both first and second recesses 16A and 22A' respectively without binding but causing mutual contact of spherical surfaces 28 and 28A with a slight play. Second member 20' lies in between the two raised side portions 14' of first member 12'. Second member 20' with its concave spherical surface 28A can pivot about the raised hemispherical protrusion 28 much more freely in all directions limited only by the restraints imposed by the raised side portions 14', pin 26' and pin heads 26A.

Figure 8:
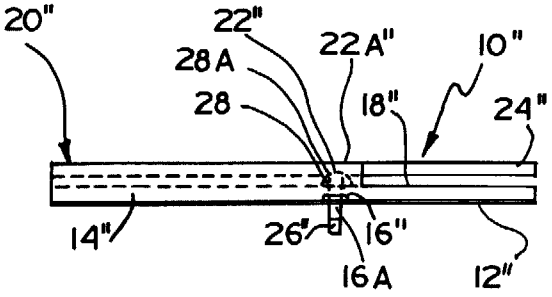
FIG. 8 is a side view of an alternate embodiment of the tap assembly of the present invention showing the interconnection of parts.
Figure 10:
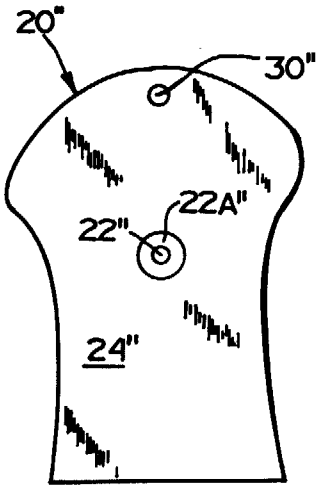
FIG. 10 is a plan view of the second member of the alternate embodiment of FIG. 8.
Figure 9:
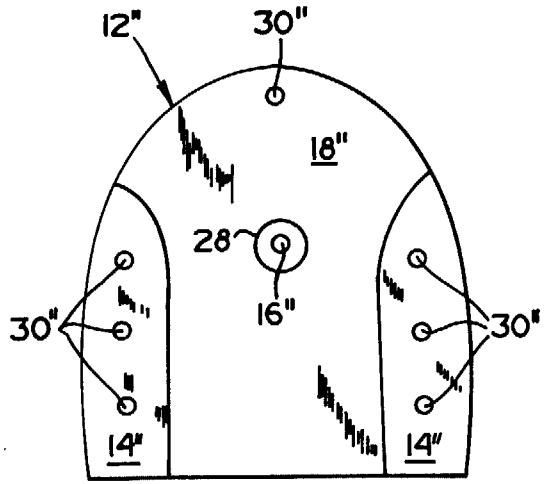
FIG. 9 is a plan view of the first member of the alternate embodiment of FIG. 8.

In FIGS. 8-10, incl., there is shown an alternate embodiment of the present invention. Pivot pin 26 as shown in FIG. 8 is in the form of a screw. This would provide an additional mounting point for attachment of the tap to the shoe. In FIG. 9 the first member 12" is generally flat and contains no open portion. It has a first central portion 18". In the middle of the first central portion 18" is a raised hemispherical protrusion 28 having at its center a through-bore 16". On the bottom of the first member 12" there is a first recess 16A where through-bore 16' commences. The entire assembly is preferably made of cast metal.

In FIG. 10 the second member 20" is shown as generally flat and has a second central portion 24". In the middle of the second central portion 24" there is a second through-bore 22". On the top of the second member 20" there is a second recess 22A" where through-bore 22" commences.

The relative positioning of the first member 12" and the second member 20" after being secured to each other by pivot pin 26 is shown in FIG. 8. Second member 20" is placed on first member 12" so that through-bore 16" and 22" are aligned to receive pivot pin 26", which through-bores are preferably of equal diameters. Pivot pin 26" is of the general cylindrical shape having a diameter smaller than that of through-bores 16" and 22". An improved tapping sound is achieved due to the increased surface area that may be contacted by second member 20" on first member 12" during use of the tap.

The shoe tap for tap dancing is secured to the shoe bottom by nails or screws placed through mounting bores 30' (30") in the first member 12 (12").

When the user places his or her foot on the floor and proceeds to dance, second member 20" (20") may slightly pivot about the raised hemispherical protrusion 28 freely in all directions limited only by the aforementioned constraints. The tapping effect is greatly increased by the use of the raised hemispherical protrusion 28 for a pivot point because as second member 20' (20") moves against the raised side portions 14' (14") of the first member 12' (12"), a tap may be created and as second member 20' (20") moves against the central portion 18' (18") of the first member 12' (12") an additional tap may be created.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. An improved shoe tap for tap dancing having a first member provided with at least two opposite raised side portions and a first through-bore disposed on a first central portion of said first member, a cut-out portion on said first member whose boundaries are defined by said portions of said first member and by said first central portion of said first member; a second member having a second through-bore disposed on a second central portion and containing a raised back portion; connecting means extending through said first and second through-bores so as to pivotally connect said first member to said second member for limited relative movement to each other wherein the improvement comprises:

a raised hemispherical protrusion coaxially disposed relative to one through-bore of one central portion of one member; and a concave spherical recess coaxially disposed relative to the other through-bore of the other central portion of the other member; said spherical surfaces being mutually contacting, so that one member being pivotally mounted to the other member can pivot freely in all directions to a limited extent about said connecting means and about said mutually contacting spherical surfaces within the confines of said raised side portions of said first member thereby increasing the tapping effect.

2. An improved shoe tap for tap dancing as in claim 1, wherein the improvement further comprises: said first member having said cut-out portion closed and said second member being flat without a raised back portion.

3. An improved shoe tap for tap dancing as in claim 1 or 2, wherein said connecting means is a rivet.

4. An improved shoe tap for tap dancing as in claim 1 or 2, wherein said connecting means is a screw extending through said joined first and second members and terminating in a shoe heel thereby providing an additional mounting point.

5. An improved shoe tap for tap dancing as in claim 1 or 2, wherein said first and second members are flat.

6. An improved shoe tap for tap dancing as in claim 1 or 2, wherein said first and second members are curved.

* * * * *